US006877884B2

(12) United States Patent
Wu

(10) Patent No.: US 6,877,884 B2
(45) Date of Patent: Apr. 12, 2005

(54) DETACHABLE LAMP ASSEMBLY DEVICE

(76) Inventor: Wen-Chang Wu, 235 Chung-Ho, Box 8-24, Taipei (TW)

( * ) Notice: Subject to any disclaimer, the term of this patent is extended or adjusted under 35 U.S.C. 154(b) by 73 days.

(21) Appl. No.: 10/410,839

(22) Filed: Apr. 11, 2003

(65) Prior Publication Data

US 2004/0201998 A1 Oct. 14, 2004

(51) Int. Cl.[7] ..... F21S 8/06
(52) U.S. Cl. ..... 362/410; 362/226; 362/389; 362/406; 362/443
(58) Field of Search ..... 362/226, 452, 362/406, 443, 277, 431, 368, 389, 374, 370, 410, 405

(56) References Cited

U.S. PATENT DOCUMENTS 4,473,869 A * 9/1984 De Widt ..... 362/226
5,632,553 A * 5/1997 Huang ..... 362/410

* cited by examiner

*Primary Examiner*—Sandra O'Shea
*Assistant Examiner*—Guiyoung Lee

(57) ABSTRACT

A detachable lamp assembly device is disclosed. A limiting reed is locked to the receiving groove. A buckling elastic piece is locked to the limit groove. Two sides of the limiting reed are installed with buckles; and the buckles slightly protrude from an edge of the receiving groove. An edge of each buckle of the reed is installed with a bank of stepped surface. Thus, after the lamp rod is inserted into the lamp seat, the lamp rod is prevented from being out of the lamp seat. Thereby, a user can assemble the lamp rod by inserting it into the lamp seat easily. Moreover, the lamp is detachable for storage and transfer with a smaller volume.

2 Claims, 5 Drawing Sheets

Fig. 1-A

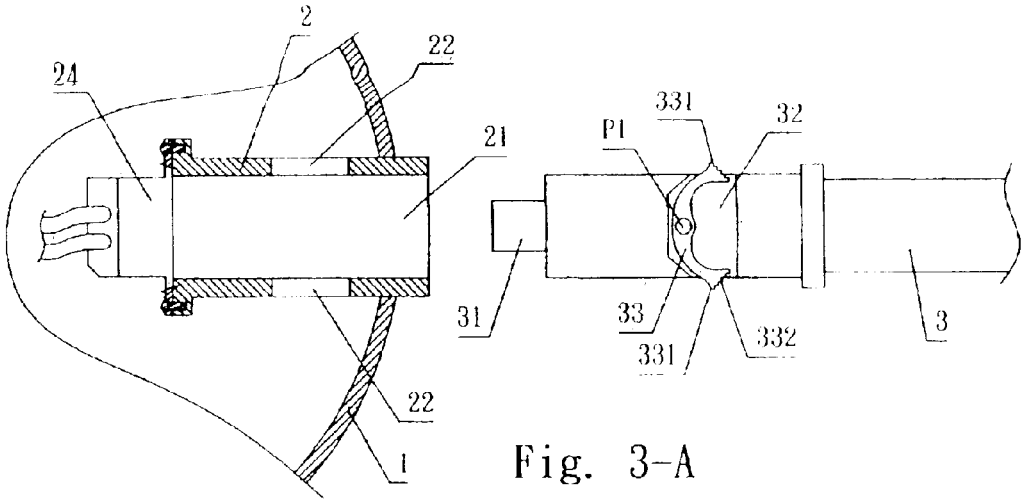
Fig. 3-A
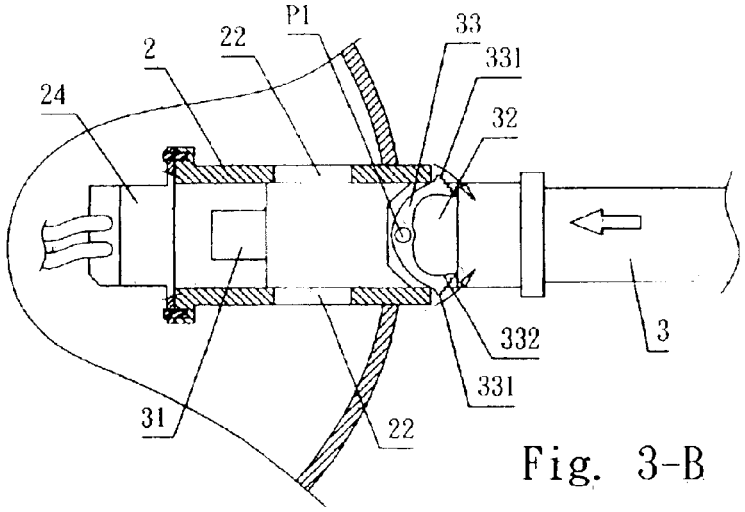
Fig. 3-B
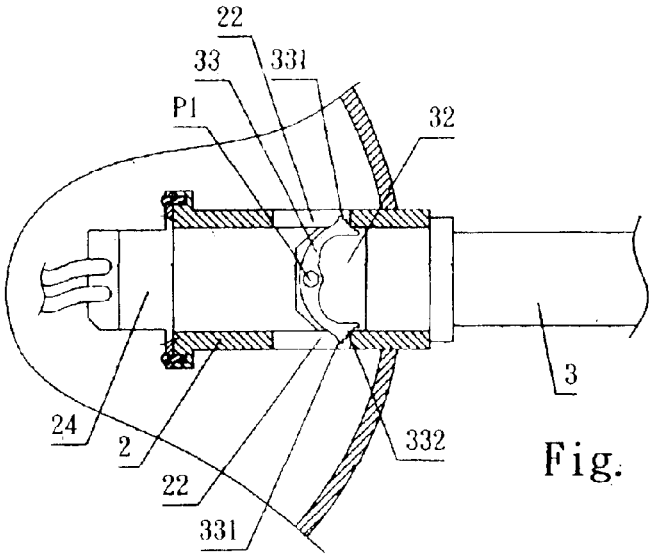
Fig. 3-C

Fig. 5-A

DETACHABLE LAMP ASSEMBLY DEVICE

BACKGROUND OF THE INVENTION

The present invention relates to lamp assembly devices, and particularly to a detachable lamp assembly device. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easy occur, but also the locking tools (for example, spanners, openers, etc.) are necessary in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a detachable lamp assembly device comprising a lamp seat firmly secured to a lateral side of a wire winding box, and a lamp rod inserted into the lamp seat. A lateral side of the wire winding box has a via hole and a portion of the lamp seat coupled to the via hole of the wire winding box has a penetrating hole. Two sides of the lamp seat are formed with embedding holes penetrated axially on a surface of the lamp seat for positioning the lamp rod. A front end of the lamp rod is exactly inserted into an end portion in the inserting seat of the lamp seat. A portion of the lamp rod coupled to the embedding holes of the lamp seat is formed with a receiving groove. A limiting reed is locked to the receiving groove. A buckling elastic piece is locked to the limit groove. Two sides of the limiting reed are installed with buckles; and the buckles slightly protrude from an edge of the receiving groove. An edge of each buckle of the reed is installed with a bank of stepped surface. Thus, after the lamp rod is inserted into the lamp seat, the lamp rod is prevented from being out of the lamp seat. Thereby, a user can assemble the lamp rod by inserting it into the lamp seat easily. Moreover, the lamp is detachable for storage and transfer with a smaller volume.

The various objects and advantages of the present invention will be more readily understood from the following detailed description when read in conjunction with the appended drawing.

BRIEF DESCRIPTION OF THE DRAWINGS

FIG. 1A is a partial enlarged view of the present invention.

FIG. 3A shows one embodiment before the insertion of the lamp rod.

FIG. 3B shows the embodiment of FIG. 3A where the lamp rod is being inserted.

FIG. 3C shows the embodiment of FIG. 3A after the insertion of the lamp rod.

FIG. 5A is a partial enlarged view of the embodiment shown in FIG. 5.

BRIEF DESCRIPTION OF THE PREFERRED EMBODIMENTS

Figure 1:
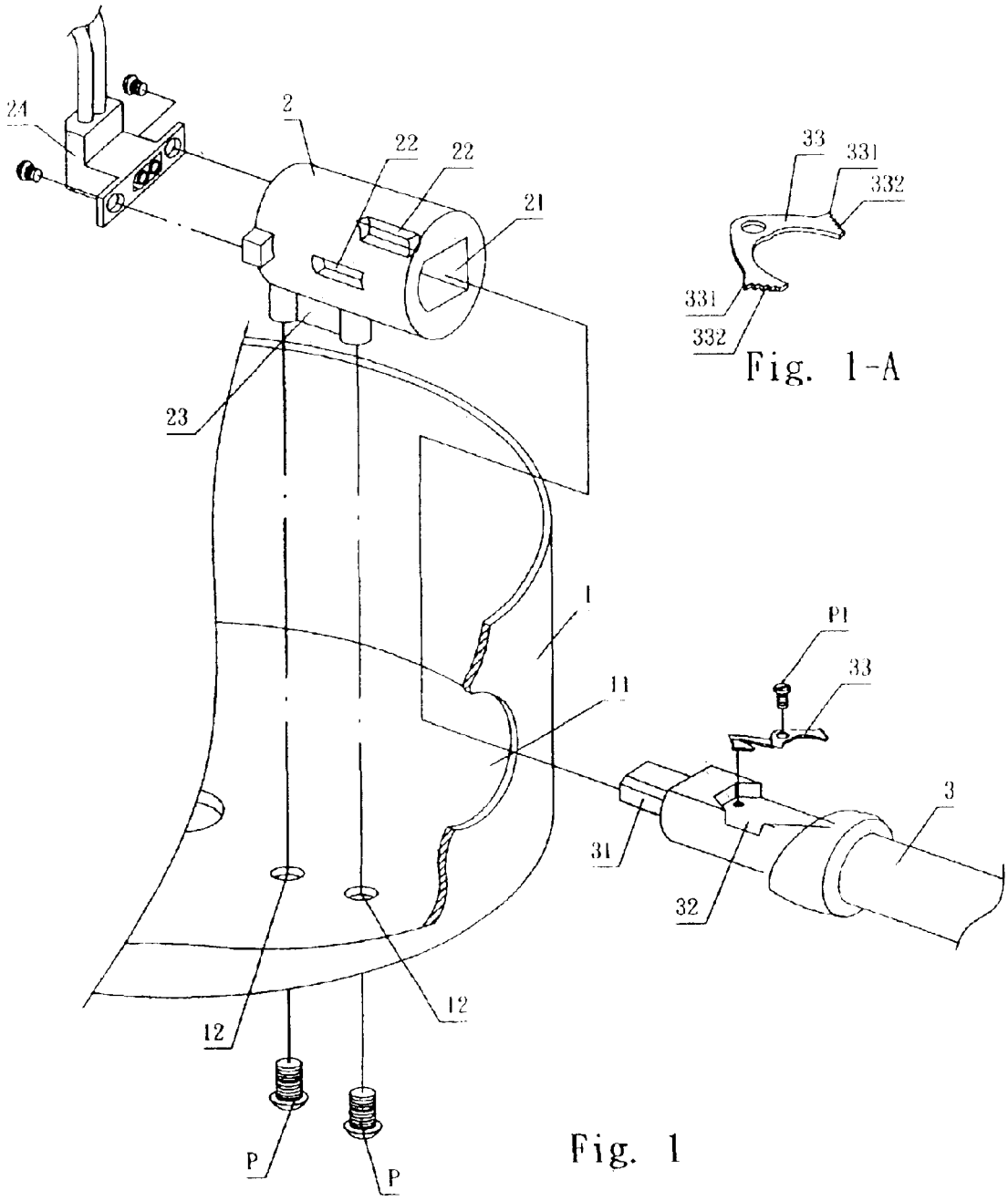
FIG. 1 is an exploded perspective view of the present invention.
Figure 2:
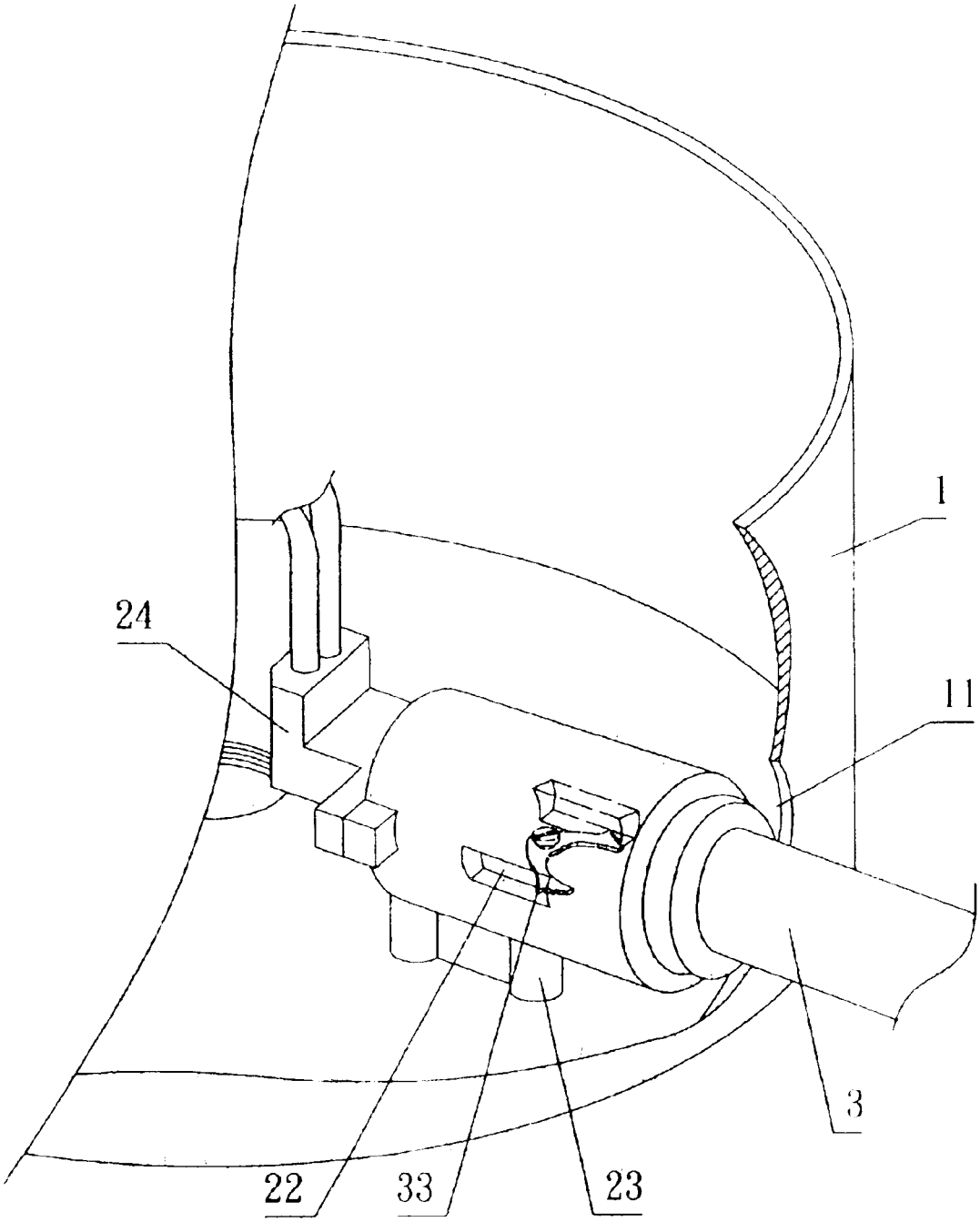
FIG. 2 is an assembled perspective view of the present invention.

Referring to FIGS. 1 and 2, the device of the present invention is illustrated. The present invention includes a lamp seat 2 firmly secured to a lateral side of a wire winding box 1, and a lamp rod 3 inserted into the lamp seat 2.

A lateral side of the wire winding box 1 has a via hole 11 and a bottom of the wire winding box 1 coupled to the lamp seat 2 has through holes 12 for being passed by a stud P so as to lock the lamp seat 2 to a predetermined positioned.

A portion of the lamp seat 2 coupled to the via hole 11 of the wire winding box 1 has a penetrating hole 21. One side of the penetrating hole 21 has an elliptical shape, and the other three sides of the penetrating hole 21 have a rectangular shape. Thereby, when the lamp rod 3 is inserted into the lamp seat 2, the lamp rod 3 cannot rotate. Two sides of the lamp seat 2 are formed with embedding holes 22 penetrated axially on a surface of the lamp seat 2 for positioning the lamp rod 3. A lower side of the lamp seat 2 protruded with a locking seat 23 with a configuration corresponding to the through holes 12 of the wire winding box 1, thereby the stud P can pass through the through holes 12 from a lower end of the wire winding box 1 and then is locked to the locking seat 23 so as to fix the lamp seat 2 to the wire winding box 1. A distal end of the lamp seat 2 is locked with an inserting seat 24 which is exactly resisted by an end portion 31 of the lamp rod 3.

A front end of the lamp rod 3 has a conductive end portion 31 which is exactly inserted into the inserting seat 2 of the lamp seat 2 for electric conduction. A portion of the lamp rod 3 coupled to the embedding holes 22 of the lamp seat 2 is formed with a receiving groove 32. A limiting reed 33 is locked from the upper side to the receiving groove 32 by a stud P1. A buckling elastic piece 33 is locked to the limit groove 32 by a stud P1. Two sides of the limiting reed 33 are installed with buckles 331. The buckles 331 slightly protrude from an edge of the receiving groove 32. An edge of each buckle 331 of the reed 33 is installed with a bank of stepped surface 332. Thus, after the lamp rod 3 is inserted into the lamp seat 2, the lamp rod 3 is prevented from being out of the lamp seat 2.

By the design of the present invention, a user can assembled the lamp rod by inserting it into the lamp seat easily; and moreover, the lamp is detachable for storage and transfer with a smaller volume.

With reference to FIG. 3, the assembly of the present invention is illustrated. The lamp rod 3 is inserted into the penetrating hole 21 of the lamp rod 3. Then the buckles 331 at two sides are pressed by the penetrating hole 21 of the lamp seat 2 so as to compress inwards into an interior of the penetrating hole 21. Then it is pushed inwards and is confined by the width of the penetrating hole 21 (referring to FIG. 3B) until the limiting reed 33 is aligned to the embedding holes 22 of the lamp seat 2. Then the two buckles 331 at two sides of the limiting reed 33 separates from the penetrating hole 21 to be ejected out. By the stepped surface 332 of each buckle, the limiting reed 33 of the lamp rod 3 is exactly buckled to the embedding holes 22 of the lamp seat 2 so as to prevent the lamp rod 3 from fall out (referring to FIG. 3C) so that the lamp rod 3 can be substantially positioned to the lamp seat 2.

Figure 4:
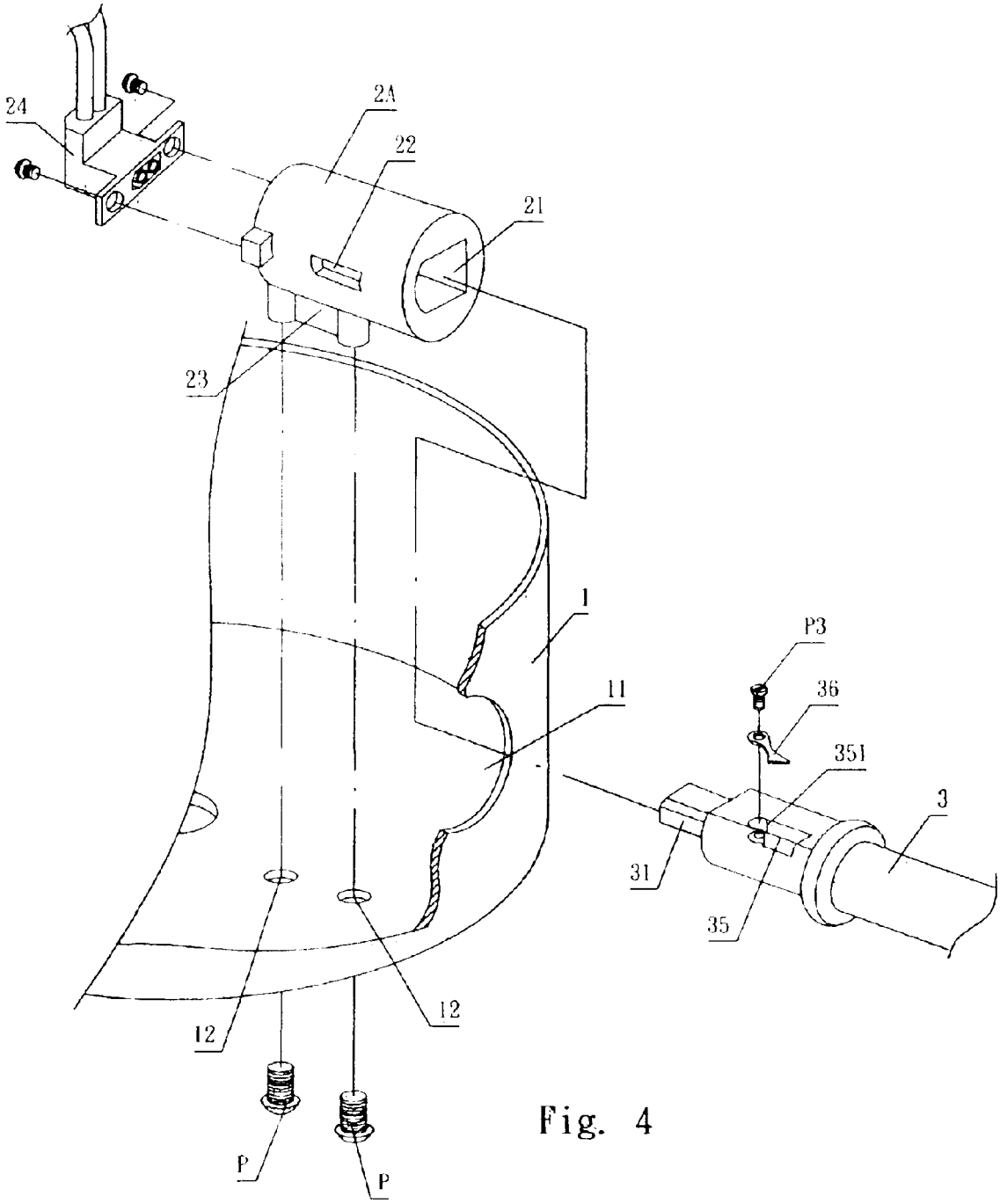
FIG. 4 shows another embodiment about the limiting reed of the present invention.

Referring to FIG. 4, another embodiment of the present invention is illustrated. One side of the lamp seat 2 has an embedding hole 22 for positioning the lamp rod 3. A lateral side of the lamp rod 3 coupled to the embedding hole 22 of the lamp seat 2 is formed with a locking groove 35. A limiting sheet 36 is locked to the locking groove 35 by a stud P3. An embedding portion 361 at a lateral side of the limiting sheet 36 slight protrudes out of the locking groove 35. Thereby, when the limiting sheet 36 is pushed inwards by the lamp rod 3, the limiting sheet 36 resisted at an inner edge of the locking groove 35 will eject outwards so as to prevent the lamp rod from being retracted from the lamp seat 2 after the lamp rod 3 is inserted.

Figure 5:
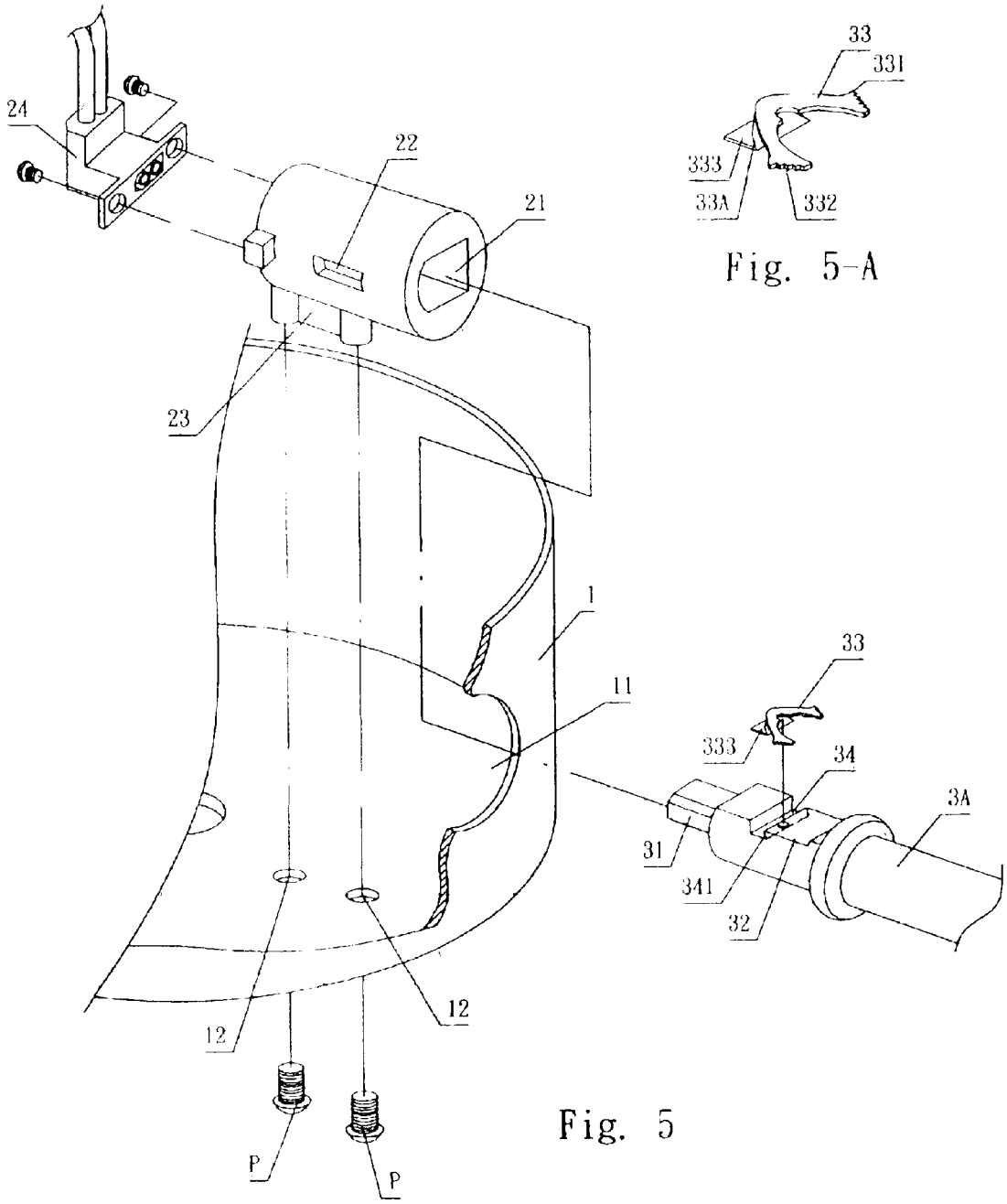
FIG. 5 shows a further embodiment about the limiting reed of the present invention.

Referring to FIGS. 5 and 5A, another embodiment for retaining the limiting reed 33 according to the present invention is illustrated. A portion of the lamp rod 3 coupled to the embedding holes 22 is formed with a retaining groove 34. One end of the retaining groove 34 is an inclined surface 341 to match to a wedge shape-elastomer 333. A tilt edge 33A of the wedge shape elastomer 333 exactly embeds into the inclined surface 341 of the retaining groove 34 so as to embed the limiting reed 33 to the lamp rod 3. By the limiting reed 33 on the lamp rod 3, the stepped surface 332 exactly resists against the embedding hole 22 so as to prevent the lamp rod 3 to separate. Thereby, the lamp rod 3 is positioned to the lamp seat 2.

By above said structure, in transferring or storage, the lamp rod 3 and the wire winding box 1 can be detached in advance so as to reduce the volume. In use, the user only needs to insert the lamp rod 3 into the lamp seat 2 with-out using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A detachable lamp assembly device comprising a lamp seat firmly secured to a lateral side of a wire winding box, and a lamp rod inserted into the lamp seat; wherein a lateral side of the wire winding box has a via hole and a portion of the lamp seat coupled to the via hole of the wire winding box has a penetrating hole; two sides of the lamp seat are formed with embedding holes penetrated axially on a surface of the lamp seat for positioning the lamp rod; and a front end of the lamp rod has an conductive end portion which is exactly inserted into the inserting seat of the lamp seat for electric conduction; a portion of the lamp rod coupled to the embedding holes of the lamp seat is formed with a receiving groove; a limiting reed is locked to the receiving groove; a buckling elastic piece is locked to the limit groove; two sides of the limiting reed are formed with buckles; the buckles slightly protrude from an edge of the receiving groove; an edge of each buckle of the reed is installed with a bank of stepped surface; thus, after the lamp rod is inserted into the lamp seat, the lamp rod is prevented from being out of the lamp seat;

thereby, a user can assemble the lamp rod by inserting it into the lamp seat easily; and moreover, the lamp is detachable for storage and transfer with a smaller volume; and wherein one side of the penetrating hole has an elliptical shape, and the other three sides of the penetrating hole have a rectangular shape.

2. A detachable lamp assembly device comprising a lamp seat firmly secured to a lateral side of a wire winding box, and a lamp rod inserted into the lamp seat; wherein a lateral side of the wire winding box has a via hole and a portion of the lamp seat coupled to the via hole of the wire winding box has a penetrating hole; two sides of the lamp seat are formed with embedding holes penetrated axially on a surface of the lamp seat for positioning the lamp rod; and a front end of the lamp rod has an conductive end portion which is exactly inserted into the inserting seat of the lamp seat for electric conduction; a portion of the lamp rod coupled to the embedding holes of the lamp seat is formed with a receiving groove; a limiting reed is locked to the receiving groove; a buckling elastic piece is locked to the limit groove; two sides of the limiting reed are formed with buckles; the buckles slightly protrude from an edge of the receiving groove; an edge of each buckle of the reed is installed with a bank of stepped surface; thus, after the lamp rod is inserted into the lamp seat, the lamp rod is prevented from being out of the lamp seat;

thereby, a user can assemble the lamp rod by inserting it into the lamp seat easily; and moreover, the lamp is detachable for storage and transfer with a smaller volume; and wherein a bottom of the wire winding box coupled to the lamp seat has through holes; a lower side of the lamp seat protruded with a locking seat with a configuration corresponding to the through holes of the wire winding box, thereby a stud passes through the through holes from a lower end of the wire winding box and then is locked to the locking seat so as to fix the lamp seat to the wire winding box.

* * * * *